US006793300B1

(12) United States Patent
Gillette

(10) Patent No.: US 6,793,300 B1
(45) Date of Patent: Sep. 21, 2004

(54) CABINET STORAGE FOR CUTTING BOARD AND METHOD

(76) Inventor: Donald Frank Gillette, 7402 Haviland Cir., Boynton Beach, FL (US) 33437

( * ) Notice: Subject to any disclaimer, the term of this patent is extended or adjusted under 35 U.S.C. 154(b) by 30 days.

(21) Appl. No.: 10/274,197

(22) Filed: Oct. 21, 2002

(51) Int. Cl.[7] ..... A47B 88/00
(52) U.S. Cl. ..... 312/328
(58) Field of Search ..... 312/328, 329, 312/237, 282; 108/90

(56) References Cited

U.S. PATENT DOCUMENTS 2,449,433 A * 9/1948 Wheelock ..... 312/290
2,910,336 A * 10/1959 Mustee ..... 312/328
3,544,182 A 12/1970 Tainter
4,101,184 A * 7/1978 Barrett ..... 312/233
4,348,967 A * 9/1982 Schattner et al. ..... 109/51
4,914,340 A * 4/1990 Fox ..... 312/211
5,031,975 A 7/1991 Anderson
5,090,785 A * 2/1992 Stamp ..... 312/319.9
5,848,772 A 12/1998 Fitzgerald
6,299,267 B1 10/2001 Butters

FOREIGN PATENT DOCUMENTS

JP 2003-185331 A1 * 7/2003

* cited by examiner

*Primary Examiner*—Ramon O. Ramirez
(74) *Attorney, Agent, or Firm*—C. J. Husar, Esq.

(57) ABSTRACT

An apparatus for the convenient storage of a cutting board in a kitchen cabinet and the method of installation thereof. The method involves three easy steps of marking the cabinet wall, cutting out the marked portion and placing a framed door and storage pocket unit into the opening formed by the removed portion and installing a plurality of screws into the frame and cabinet wall to secure the unit in place. The apparatus has a frame and hinged door that includes a storage pocket on the inside thereof for receiving a cutting board and is retractable to expose the cutting board for ready use. After use, the cutting board is returned to the pocket and the cutting board is stored out-of-the-way ready for future use. Two embodiments of the frame member are disclosed.

9 Claims, 2 Drawing Sheets

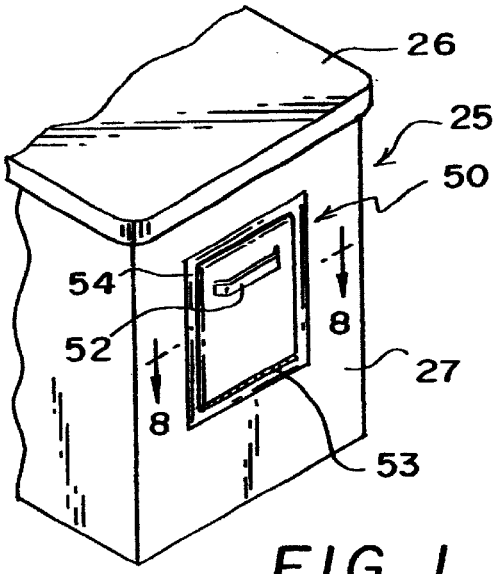
FIG. 1
FIG. 2
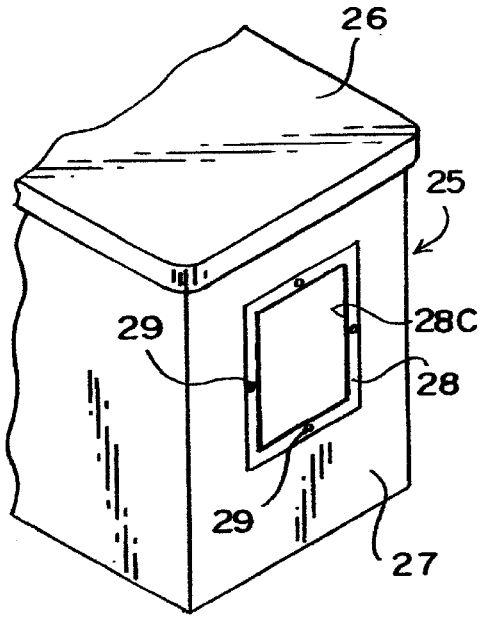
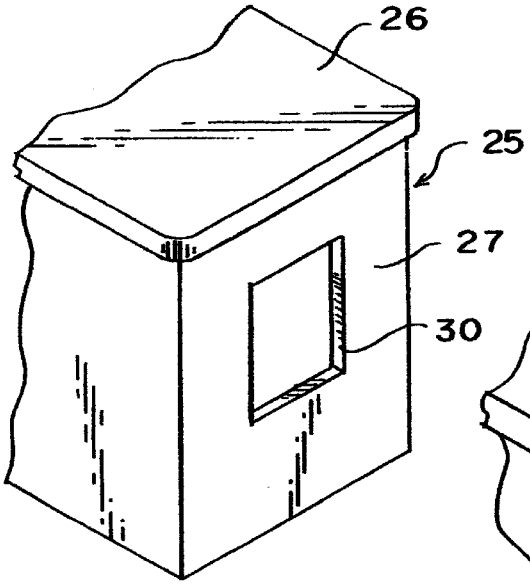
FIG. 3
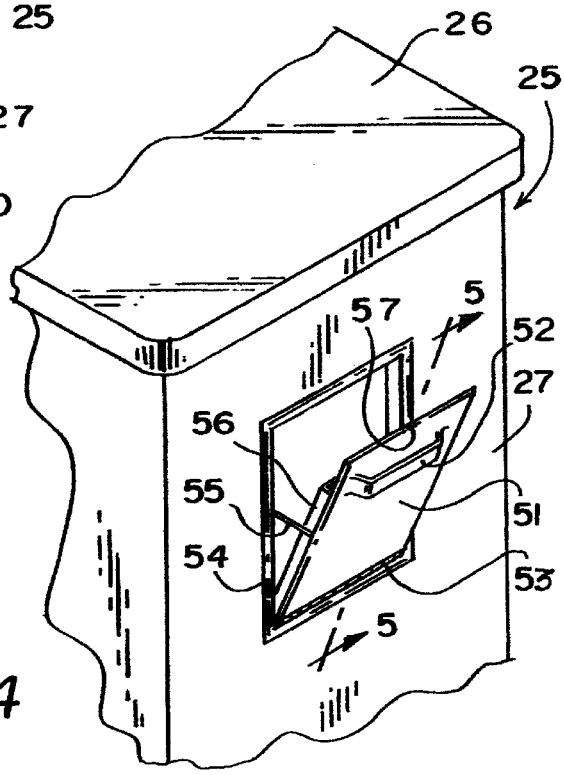
FIG. 4

FIG. 5
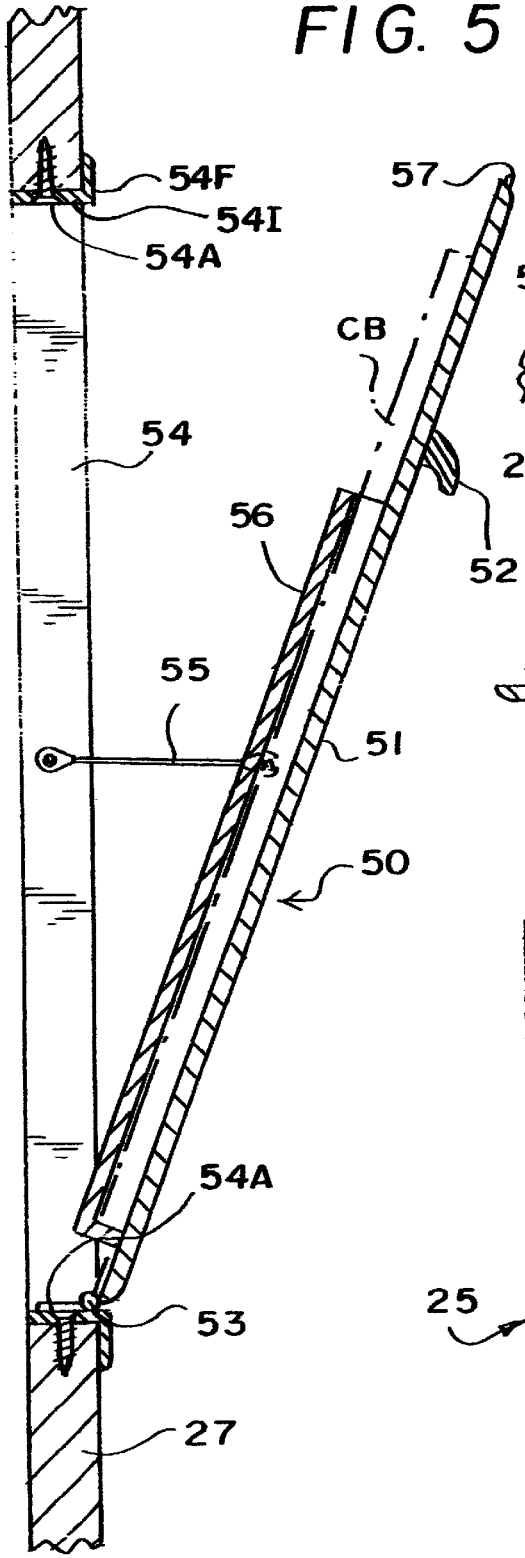
FIG. 8
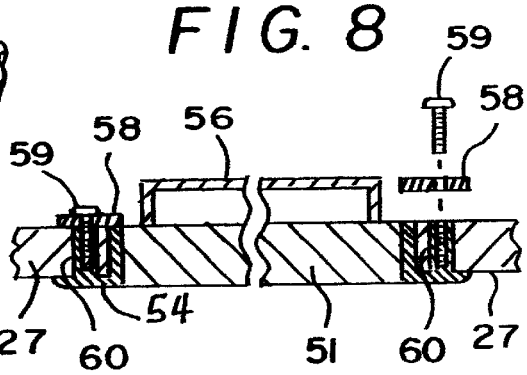
FIG. 7
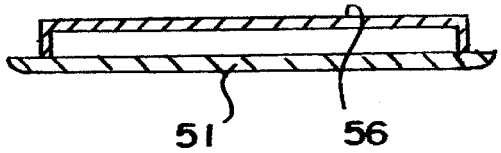
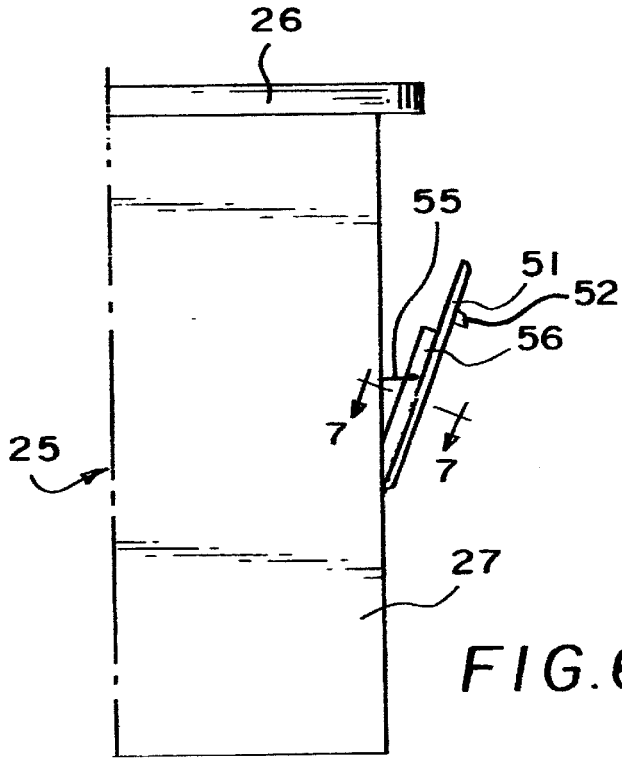
FIG.6

CABINET STORAGE FOR CUTTING BOARD AND METHOD

BACKGROUND OF THE INVENTION

The present invention relates to a kitchen cutting board storage area and more specifically, it relates to a conveniently located cutting board storage area in a kitchen cabinet and a method of installing a cutting board storage area in a kitchen cabinet.

Any cook or chef who is worth his salt, has experienced at one time or another, the problem of finding the cutting board when in the middle of preparing a meal for the family gathering or just cooking for the shear enjoyment and pleasure in knowing that you are the one in-charge of presenting a delicately prepared meal. In most instances, when it comes time for chopping the chicken, celery or onions, rolling pasta dough or pie crust dough, we are suddenly hit with the question, "where is the cutting board?" When this rhetorical question is asked, the hunt begins and sometimes without any success. The cutting board cannot be located since it is usually stored in an out-of-the-way place so as to not interfere with other items in a drawer, especially so, due to its size.

In view of this problem, applicant has developed a method for easily installing a storage pocket for the cutting board in an end kitchen cabinet side wall where it is conveniently stored until needed for its next use without the usual frustration encountered in locating the cutting board.

DISCUSSION OF THE KNOWN PRIOR ART

A prior art search was made in the appropriate classes of the U. S. Patent Office files and revealed the following prior art patents.

U.S. Pat. No. 6,299,267—issued to Butters on Oct. 9, 2001—discloses a cabinet mounted cutting board mounting member for attachment to the underside of a cabinet over a countertop.

U.S. Pat. No. 5,848,772—issued to Fitzgerald on Dec. 15, 1998—discloses a cutting board storage holder similar to the Butters, '267 device in that it is installed in a concealed manner under a wall kitchen cabinet or under a shelf.

U.S. Pat. No. 5,031,675—issued to Anderson on Jul. 16, 1991—discloses a housing and complex operating mechanism for the automatic extension and withdrawal of a horizontally mounted cutting board beneath the countertop of a cabinet assembly.

U.S. Pat. No. 3,544,182—issued to Tainter on Dec. 1, 1970—discloses a kitchen cutting board storage unit that is vertically mounted for upright storage. In the installation of this unit, a special cabinet spacer is required to make room for the necessary storage area.

As can be seen from a review of the above noted prior, three of these patents are mounted for horizontal storage and the one mounted for vertical storage requires a special cabinet spacer unit to accommodate the cutting board holder.

SUMMARY OF THE INVENTION

The present invention provides a method of installing a cutting board storage pocket into an existing kitchen cabinet end unit with a minimum amount of restructuring of the cabinet end unit. All that is required is a series of steps, including the placement of a template on the end cabinet in the desired location, removing the marked area of the template from the end cabinet and installing an integral frame, door and pocket unit by installing a few screws. The frame/door unit includes a pull handle or knob, a door check that limits the opening of the door and a detent button that securely holds the door in its closed position. The location of the mounting is such that it requires a minimum amount of previously unused space that will not interfere with any shelving or drawers of the cabinet unit and can be installed with a minimum amount of skill in a relatively easy procedure and when completed, provides an aesthetically pleasing addition to the cabinet side wall. Two embodiments of the frame and its mounting are disclosed.

OBJECTS OF THE INVENTION

An object of the invention is to provide a convenient storage pocket for a kitchen cutting board.

Another object of the invention is to provide a method of installing a cutting board door/pocket into an existing kitchen cabinet.

A further object is to provide an installation method that comprises a few easy steps and can be accomplished by the average do-it-yourself homeowner.

Yet another object of the invention is to provide a storage unit that once installed, it provides an aesthetically pleasing appearance that will blend in with the kitchen decor.

A still further object of the invention is to provide a convenient storage pocket for a kitchen cutting board that eliminates the problem of locating the cutting board when needed in the middle of a cooking project for use.

Another object of the invention is to provide a storage pocket in an area that is normally an unused portion of a standard end cabinet unit.

These and other objects of the invention will become more apparent hereinafter. The instant invention will now be described with reference to the accompanying drawings wherein like reference characters designate the corresponding parts throughout the several views.

BRIEF DESCRIPTION OF THE DRAWINGS

FIG. 1 is an illustration of the novel cutting board framed door/pocket unit installed in an end kitchen cabinet unit.

FIGS. 2 and 3 illustrate the preparatory steps for installing the framed door/pocket unit in the cabinet.

FIG. 4 is another perspective view showing the framed door/pocket installed therein with the door in its open position.

FIG. 5 is a sectional view taken along the plane 5—5 of FIG. 4 illustrating details of the frame mounting with the cutting board shown in phantom.

FIG. 6 is a vertical side view of an end cabinet with the door/pocket opened.

FIG. 7 is a sectional view taken along the plane 7—7 of FIG. 6 illustrating the pocket relative to the door.

FIG. 8 is a sectional view taken along the plane 8—8 of FIG. 1 showing an alternative frame and its manner of mounting in the cabinet.

DETAILED DESCRIPTION OF THE DRAWINGS

Referring now to FIG. 1, there is shown a perspective view of an end cabinet 25 with the usual countertop 26 having an end vertical wall 27 and the novel frame door/pocket unit 50 installed therein. As illustrated, the door 51 is shown in its normal closed position.

FIG. 2 illustrates the first step utilized in installing the framed door/pocket unit 50 into an end cabinet vertical wall 27. As shown, a template 28 that simulates the size of frame 54 of the unit 50, includes a peel-off backing adhesive layer that has been removed prior to its positioning on vertical wall 27 in the location where it is desired to locate the frame door/pocket unit 50. As shown, template 28 includes an inner border 28C, where the cutting is to occur to provide an opening 30 for unit 50. Additionally, markings 29 are provided where holes are to be drilled for the mounting for one of the two frame embodiments disclosed. If the second frame embodiment is used, the drill markings are merely ignored and proceed to the next step of installation.

Turning to FIG. 3, there is shown the opening 30 after the cut has been made along inner border line 28C of template 28 and template 28 has been removed in preparation for the installation of frame door/pocket unit 50.

FIG. 4 is an illustration of the cabinet 25 with a framed door/pocket unit installed therein. As shown, door 51 is in its open position and includes a door stop or check 55 that limits the extent of opening of door 51. As shown door stop 55 is a flexible nylon line secured to the door 51 and cabinet opening 30 to limit the opening of door 51, however, other suitable hardware means may be utilized as well. Door 51 further includes a detent button 57 located at the top of door 51 for holding door 51 in its closed vertical position. A piano type hinge 53 is shown at the bottom of door 51 hingedly connecting door 51 to frame 54. Although a piano-type hinge 53 is shown, other suitable hinge means can be utilized equally as effectively. A handle 52 is shown attached to the door 51. Other types of handles means may be utilized such as matching cabinet pull handles, a pull knob or alternatively, a recessed finger well in the outer face of door 51 to provide for finger engagement therewith.

FIG. 5 is a vertical cross-sectional view taken along the plane 5—5 of FIG. 4, illustrating an enlarged view thereof. Again, framed door/pocket unit 50 is shown in its open position. However, there is also shown in phantom cutting board CB received in pocket 56, resting adjacent the inner surface of door 51 ready for use. Located at the uppermost edge of door 51 is a detent button 57 that cooperates with a dimple (not shown) in frame 51 for holding door 51 in its closed vertical position. As illustrated frame 54 is a right-angle member having a frontal portion 54F and an inward portion 54I that abuts the periphery of opening 30 and is secured therein by a plurality of screws 54A.

FIG. 6 is a side view of cabinet 25 with door 51 in its open position.

FIG. 7 is a horizontal sectional view taken along the plane 7—7 of FIG. 6 illustrating the pocket 56 and its relationship to door 51.

FIG. 8 is another horizontal sectional view, taken along the plane 8—8 of FIG. 1, illustrating an alternative embodiment of frame 54 and its mounting in cabinet 27. In this embodiment, frame 54 is shown as a right-angled member with one leg having four internally threaded posts 60 integral with the inner surface of the exposed frame 54 and the other leg in abutment with opening 30. The left-hand portion of this figure illustrates clip 58 and attaching screw 59 inserted in post 60 while the right-hand portion illustrates clip 58 and screw 59 about to be inserted into post 60. This is the embodiment wherein the drill holes 29 of template 28, of FIG. 2, are utilized. After opening 30 has been cut-out and holes 29 drilled, frame member 54 is received therein and retaining clips 58 are held in place when screws 59 are inserted into internally threaded posts 60. Merely inserting frame door/pocket unit 50 into cut-out opening 30 and the addition of retaining clips 58 and screws 59 completes the installation of the novel frame door/pocket 50 and it is now ready for installation of cutting board CB therein and the problem of locating the cutting board CB becomes a memory of days gone by.

While the invention has been described in its preferred embodiment, it is to be understood that the words which have been used are words of description rather than words of limitation and that changes may be made within the purview of the appended claims without departing from the full scope or spirit of the invention. Accordingly, the present invention is t be limited only by the appended claims, and not by the foregoing specification.

Having thus described my invention, I claim:

1. A cutting board storage unit for mounting in an existing cabinet end wall, said unit comprising:

mounting frame means and door means hingedly connected thereto;

said door means having an inner surface and an outer surface and including an integral cutting board receiving pocket mounted on said inner surface;

handle means fixedly secured to said outer surface of said door means and latching means attached to said door means for cooperating with a dimple retainer in said frame means to hold said door means in closed position;

said door means further including a door stop for limiting the extent of opening of said door means whereby said storage unit may be opened and a cutting board may be inserted into said pocket and stored therein for future use;

said frame member comprising a right-angled member with one leg engaging a cabinet opening and the leg having a plurality of screw receiving posts projecting therefrom and receivable in a plurality of cabinet securement holes; and a plurality of retaining clips and screws received in said screw posts for securing said cutting board storage unit in a cabinet end wall.

2. A cutting board storage unit as defined in claim 1 wherein said stop means for limiting the extent of door opening is a flexible element secured at opposite ends to said door means and said frame means.

3. A cutting board storage unit as defined in claim 1 wherein said door means includes latching means for securely holding said door in a closed position when not in use.

4. A cutting board storage unit as defined in claim 1 wherein said handle means comprises a recessed finger well in the outer surface of said door means for opening and closing said door means.

5. A cutting board storage unit as defined in claim 4 wherein said latching means includes a projecting detent button on said door periphery that engages a dimple portion on said frame means to hold said door in a closed position.

6. The combination of a kitchen cabinet and a cutting board storage unit comprising:

a kitchen cabinet having an end wall with a vertical opening therein;

said cutting board storage unit comprising frame means received in said cabinet opening; and door means having an inner surface and an outer surface hingedly connected to said frame portion for movement between an open and closed position;

a storage pocket mounted on said inner surface for receiving a cutting board therein for storage;

said outer surface of said door means including a handle for opening and closing said door means; and cooperating latching means on said door and frame portion for holding said door means in its closed position whereby said cutting board storage unit provides a convenient storage area for a cutting board when not in use and readily available when needed.

7. The combination of a kitchen cabinet and a cutting board storage unit as defined in claim 6 wherein said door means includes stop means for limiting the extent of door opening.

8. The combination of a kitchen cabinet and a cutting board as defined in claim 6 wherein said frame means is held in position by a plurality of retaining clips and screws that are received in threaded posts on said frame means.

9. A method for installing a cutting board storage unit in an end wall of a kitchen cabinet, said method comprising the following steps:

a. placing a template on the vertical end wall of a kitchen cabinet in the desired location;

b. cutting out and removing a portion of said end wall by following the inner border of said template;

c. inserting a cutting board storage unit including a frame portion, door and pocket on said door into the opening formed by the removal of a portion of said cabinet end wall; and d. inserting fastening means through said frame portion of said cutting board storage unit and said cabinet end wall for securing said storage unit to said cabinet end wall whereby said pocket on said door is ready for insertion of a cutting board therein.

* * * * *

UNITED STATES PATENT AND TRADEMARK OFFICE

CERTIFICATE OF CORRECTION

PATENT NO. : 6,793,300 B1
DATED : September 21, 2004
INVENTOR(S) : Donald Francis Gillette It is certified that error appears in the above-identified patent and that said Letters Patent is hereby corrected as shown below:

Title page,
Item [75], Inventor, the inventor's full name is as follows:

-- Donald Francis Gillette --

Signed and Sealed this

Fourteenth Day of December, 2004

JON W. DUDAS
*Director of the United States Patent and Trademark Office*